US009956785B2

(12) United States Patent
Jacobs et al.

(10) Patent No.: US 9,956,785 B2
(45) Date of Patent: May 1, 2018

(54) PRESSURE SPIKE ELIMINATOR FOR PRINT HEADS

(71) Applicant: XEROX CORPORATION, Norwalk, CT (US)

(72) Inventors: Robert Mark Jacobs, Tigard, OR (US); Rodney B. Hill, Mt. Angel, OR (US); Terrance L. Stephens, Canby, OR (US); Chad D. Freitag, Portland, OR (US); Blake Terry Weimer, Woodburn, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days. days.

(21) Appl. No.: 15/277,628

(22) Filed: Sep. 27, 2016

(65) Prior Publication Data

US 2018/0086090 A1 Mar. 29, 2018

(51) Int. Cl.
*B41J 2/175* (2006.01)
*B41J 2/14* (2006.01)

(52) U.S. Cl.
CPC ..... *B41J 2/17523* (2013.01); *B41J 2/14* (2013.01)

(58) Field of Classification Search
CPC ..... B41J 2/17; B41J 2/17523; B41J 2/17556; B41J 2/19; B41J 2/195; B41J 2202/07; B41J 2/055; B41J 25/006
See application file for complete search history.

(56) References Cited

U.S. PATENT DOCUMENTS

| | | | | |
|---|---|---|---|---|
| 4,124,853 | A | 11/1978 | Kattner et al. | |
| 4,347,524 | A | 8/1982 | Engel et al. | |
| 6,209,997 | B1 | 4/2001 | Duong et al. | |
| 6,402,312 | B1 | 6/2002 | Shekalim | |
| 2005/0151802 | A1* | 7/2005 | Neese | B41J 2/17513 347/85 |
| 2013/0169710 | A1* | 7/2013 | Keefe | B41J 2/175 347/17 |
| 2015/0015645 | A1* | 1/2015 | Bui | B41J 2/19 347/92 |

* cited by examiner

*Primary Examiner* — Geoffrey Mruk
*Assistant Examiner* — Scott A Richmond
(74) *Attorney, Agent, or Firm* — Marger Johnson

(57) ABSTRACT

A device includes a first connector arranged to connect to an ink supply, a second connector arranged to connect to a print head, a first chamber arranged between the first and second connectors, the first chamber forming an ink path from the first connector to the second connector, a second chamber arranged adjacent to the first chamber, and a compliant wall between the first and second chambers.

A system includes a print head, an ink tank connected to the print head, and a compliant wall device connected between the print head and the ink tank, the compliant wall device having a first chamber forming an ink path between the print head and the ink tank and a second chamber, the first and second chamber separated by a compliant wall.

12 Claims, 7 Drawing Sheets

PRESSURE SPIKE ELIMINATOR FOR PRINT HEADS

TECHNICAL FIELD

This disclosure relates to print heads, more particularly to connection between the print head and the ink tank.

BACKGROUND

Ink jet printing systems typically consist of an ink delivery system connected to a print head. The print head has electronics that control the flow of ink from the ink delivery system through the print head to the print substrate, such as paper. The ink delivery system typically connects to the print head through a conduit using a quick connect/disconnect device. A vacuum pump may provide the optimized operating print head pressure.

Connection and disconnection of the conduit may cause negative pressure spikes that draw air bubbles into the print head apertures. During printing, physical movement of the print head and complex fluid interactions can also result in ink pressure spikes. Air bubbles cause defects in the printed image, because instead of jetting ink, they jet air, so no ink lands on the substrate. In addition, the burst of air can cause spattering and other defects.

Many solutions to managing air in filling and using printing systems involve redesigning various aspects of the printing system.

SUMMARY

An embodiment is a device including a first connector arranged to connect to an ink supply, a second connector arranged to connect to a print head, a first chamber arranged between the first and second connectors, the first chamber forming an ink path from the first connector to the second connector, a second chamber arranged adjacent to the first chamber, and a compliant wall between the first and second chambers.

Another embodiment is a system including a print head, an ink tank connected to the print head, and a compliant wall device connected between the print head and the ink tank, the compliant wall device having a first chamber forming an ink path between the print head and the ink tank and a second chamber, the first and second chamber separated by a compliant wall.

DETAILED DESCRIPTION OF THE EMBODIMENTS

Figure 1:
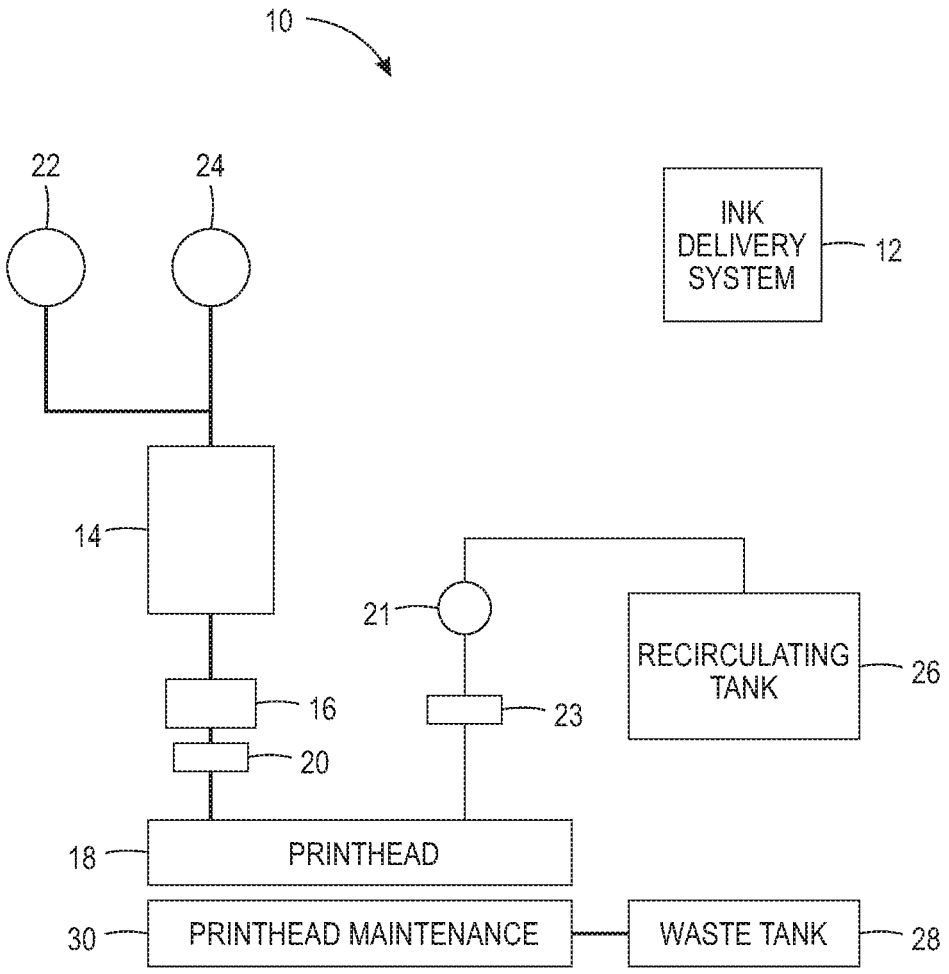
FIG. 1 shows a system embodiment of an ink jet printing system.

FIG. 1 shows an embodiment of an ink jet printing system 10. Some of the components shown here may be optional.

Some or all of the components may reside inside one housing or case, or some may be inside a case and others may be external. The print head 18 typically consists of a local ink reservoir and a 'jet-stack.' A jet stack consists of a series of thin metal, polymer, or both, plates that, when stacked together, form ink channels and provides actuators to move the ink. The actuators act on chambers formed by the stack of plates and push ink out of selected ones an array of holes contained in the last plate in the stack, typically referred to as the nozzle plate.

Ink enters the print head through an ink delivery system 12, which delivers ink to the ink tank 14. The ink tank connects to the print head through a quick disconnect fitting 20. The delivery of the ink to the print head may occur under pressure. A vacuum pump 22 may control the pressure, although the system may include other means of controlling the pressure of the ink being delivered. The system may also control the process of purging old ink from the system using a purge pump 24.

The purging of the system may drive ink into a recirculation tank 26 having its own quick release fitting or disconnect 23, with the connection being monitored by a valve or pressure regulator 21. A print head maintenance attachment 30 may also siphon off the old ink in the system into a waste tank 28. All of the pressures throughout the system require close monitoring. During a disconnect, negative pressure spikes occur that may draw air into the system.

To manage the pressures and to manage the pressure spikes, the compliant wall device 16 resides between the ink tank 14 and the print head 18. The compliant wall device is backwards-compatible having quick disconnect fittings. The ink tank conduit has a fitting on one side of the quick disconnect and the print head has the fitting on the other side of the quick disconnect. The compliant wall device has the same fittings to allow it to be inserted into the ink path of any existing print head using quick disconnect fittings.

Figure 2:
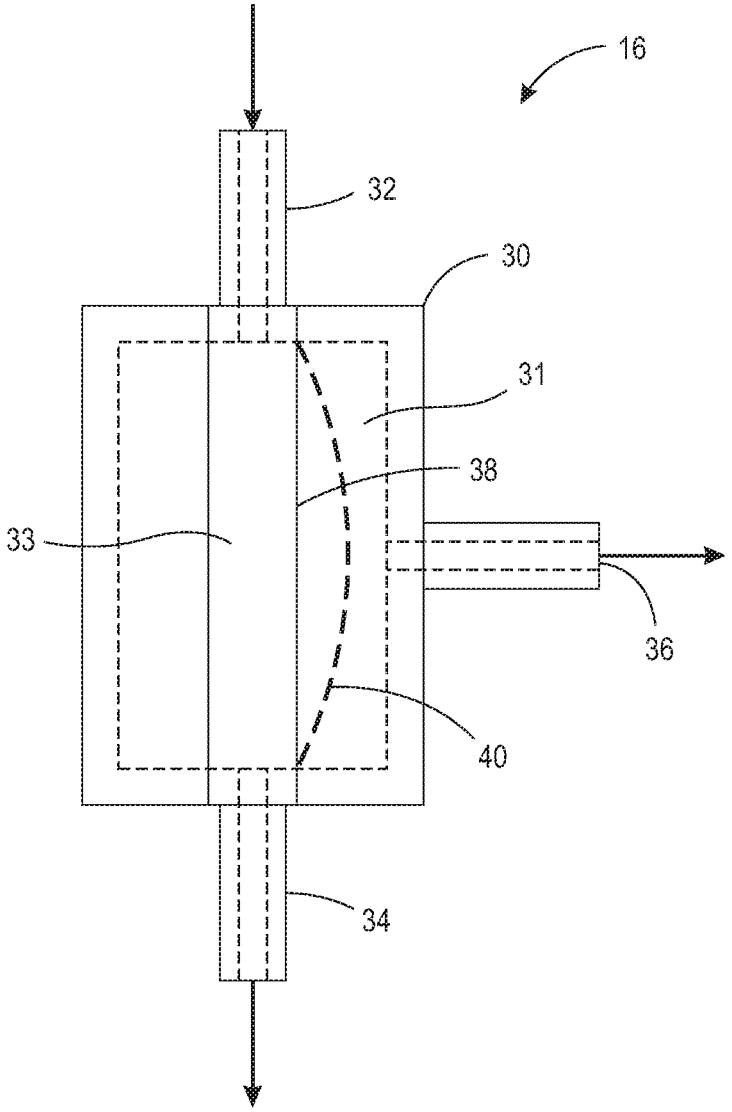
FIG. 2 shows an embodiment of a compliant wall device.

The compliant wall device is called that because it contains a wall of compliant material such as polymer, plastic, or even thin stainless steel. FIG. 2 shows a more detailed view of the device 16. The device 16 has a fitting 32 that connects the device to the ink tank and another fitting 34 that connects the device to the print head, as discussed above. The ink flows in through fitting or connector 32 through the ink chamber 33 in the housing 30 to the connector or fitting 34. In the embodiment of FIG. 2, there is a compliant wall 38 on one side of the ink path. The compliant wall 38 may deflect as shown by the dashed line 40 to manage the pressure fluctuations and to avoid the entry of air into the print head. The pressure control chamber 31 between the compliant wall 38 and the side of the housing 30 has sufficient depth to allow the membrane to deflect freely.

As the membrane deflects, air in the chamber will be pushed out of the pressure chamber 31 through air vent 36. One should note that this is not air entering the system in the ink path, but just atmosphere that fills the pressure chamber when pressure is neutral, meaning that the membrane is not deflected. A pressure regulator may be attached to the air vent to monitor and control the pressure in the compliant wall device housing 30.

A vacuum pump or pumps may control the pressure in the ink supply, while adjusting for the height of the tank relative to the print head to optimize the print head pressure. An additional vacuum pump may be used to provide an optimum pressure at the compliant wall device, or the print head vacuum pump may be used if the compliant wall device is placed at the optimum height. Alternatively, the pressure of both the print head and compliant wall device may be controlled by the height of the tank and the compliant wall device. Regardless of the method of controlling the pressure, controlling the resulting pressure across the membrane provides the greatest absorption of pressure spikes during ink connection to maintain the optimum print head pressure.

Figure 3:
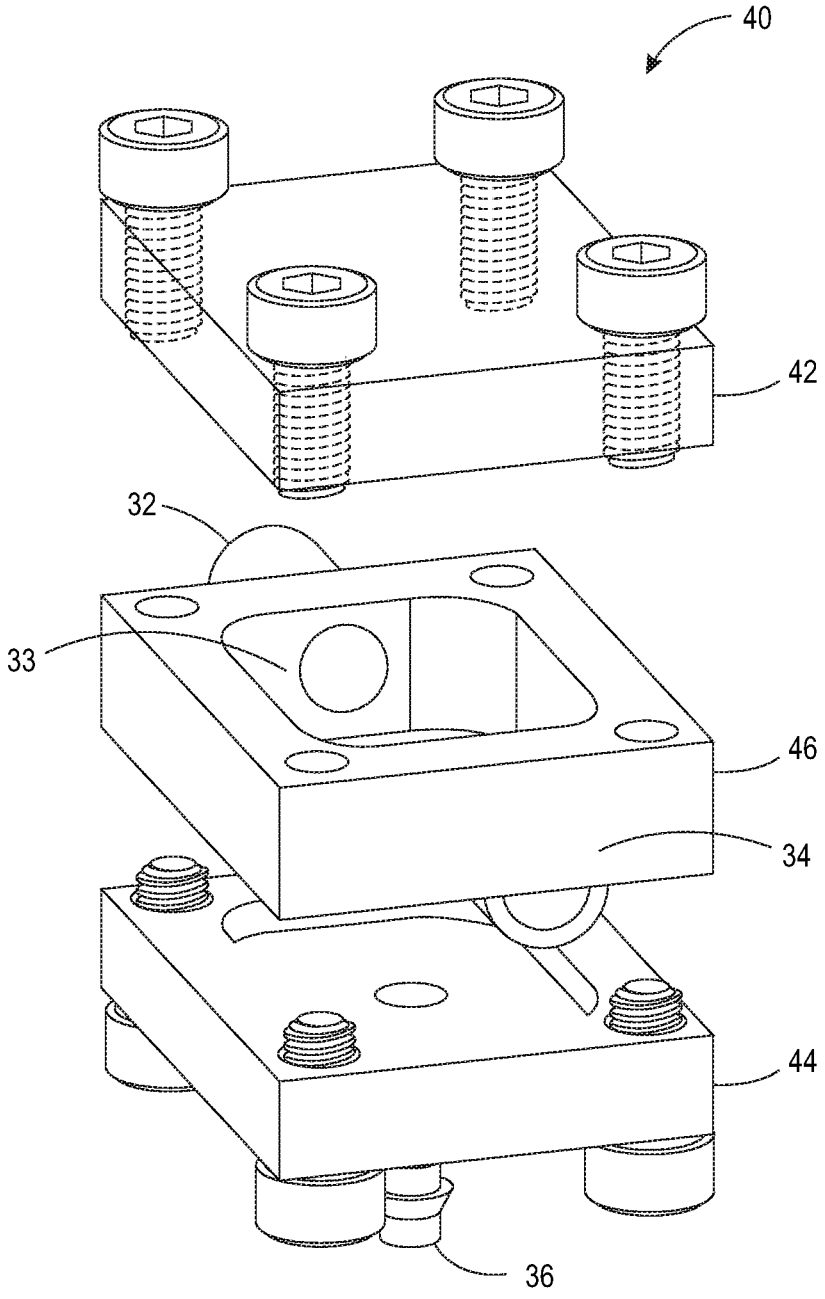
FIG. 3 shows a three-dimensional view of an embodiment of a compliant wall device
Figure 4:
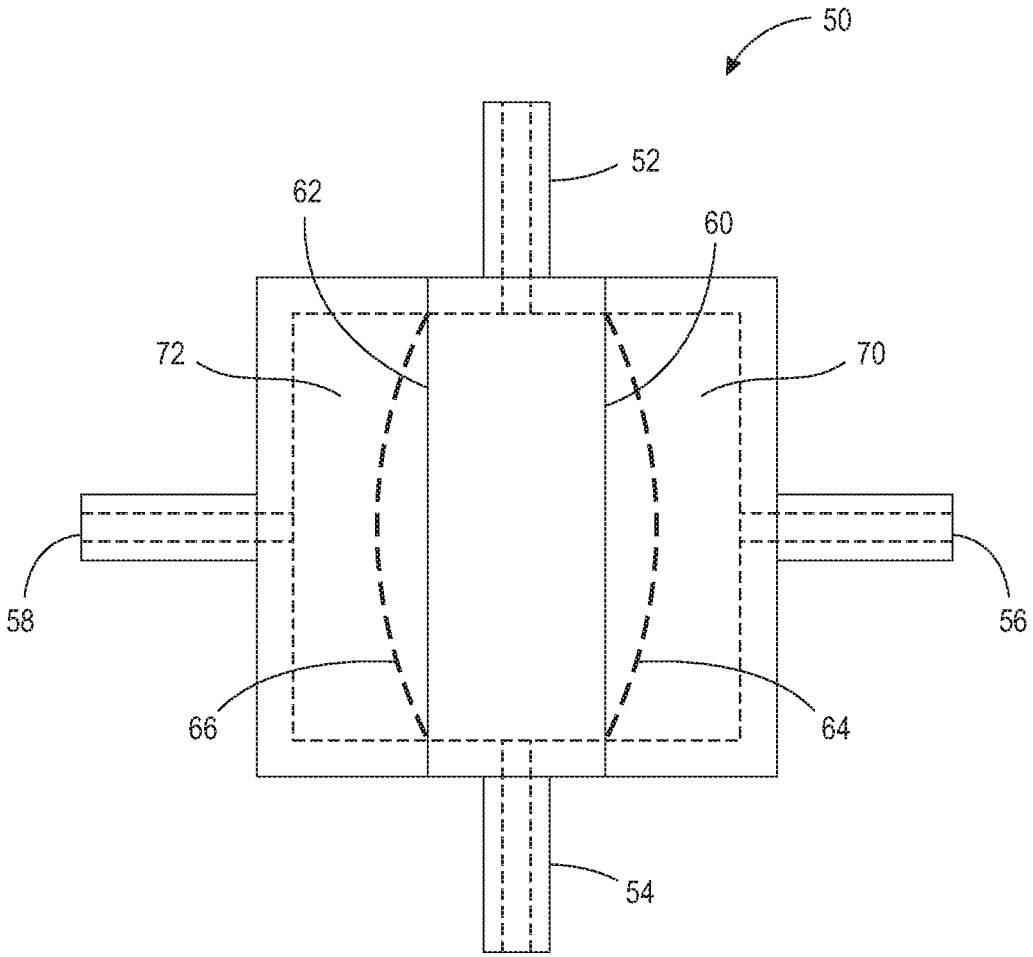
FIG. 4 shows an alternative embodiment of a compliant wall device.

FIG. 3 shows a three-dimensional view of the device 16 with a more detailed view of the housing 30. In this embodiment the housing has three parts. Connection plates 42 and 44 have an interior void region into which the membrane can deflect. The middle portion 46 forms the ink chamber 33. The ink flows into the middle portion 46 through the input connection 32 and out the output connection 34.

In the view of FIG. 3, while the ink flows in a similar path as that shown in FIG. 2, but the membrane would actually deflect up and down relative to the page. As can be seen in FIG. 3, the air vent 36 lies at the bottom of the housing. One would need to rotate the housing ninety degrees counter clockwise around the ink path to show the membrane deflecting to the left or right. The compliant wall, not shown would reside between the center portion 46 and either of the connector plates 42 or 46, essentially covering either the top or bottom opening of the ink chamber 50.

In an alternative embodiment, both of the openings of the ink chamber 50 of FIG. 3 may each have membranes. In this embodiment, two compliant walls surround the ink chamber. The ink path is formed between the input port 52 and the output port 54, with compliant walls 60 and 62. The compliant walls form two pressure chambers 70 and 72. The compliant membranes 60 and 62 can deflect individually or simultaneously into the positions show at 64 and 66, respectively. Each pressure chamber has its own air vent, such as vent 56 for chamber 70 and vent 58 for chamber 72.

Figure 5:
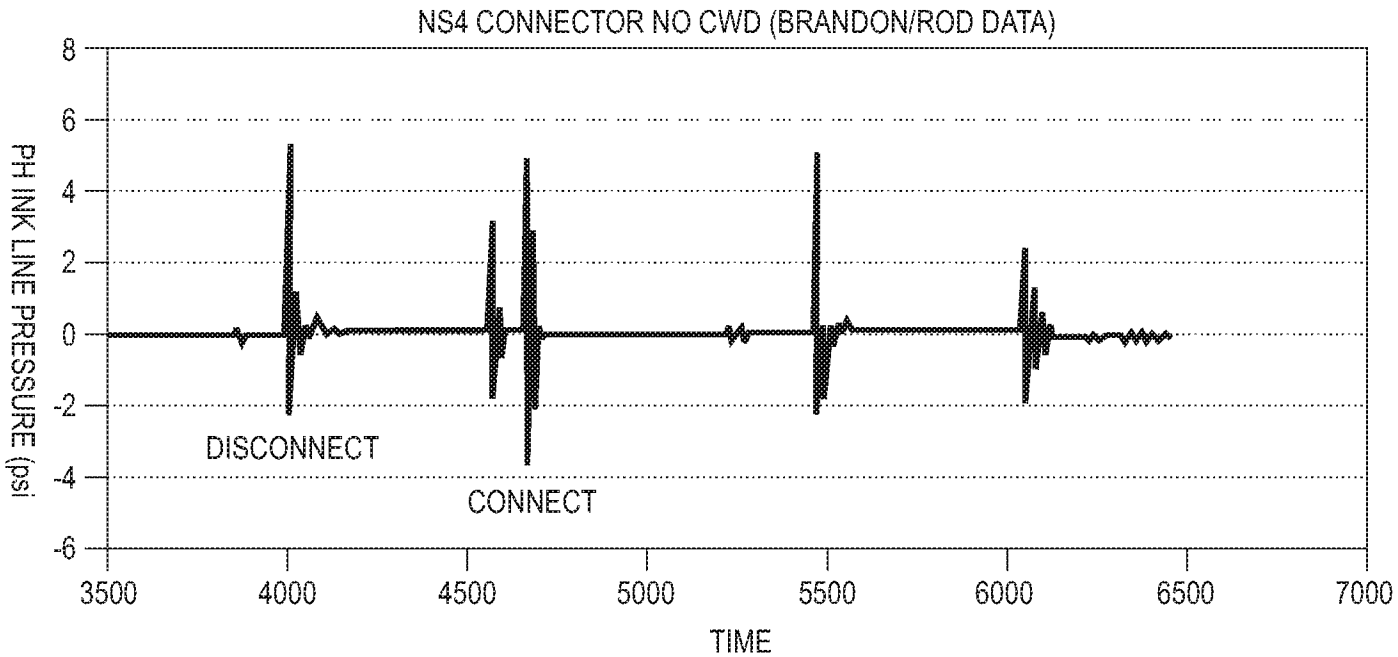
FIG. 5 shows a graph of pressure over time in the ink head line pressure without a compliant wall device.
Figure 6:
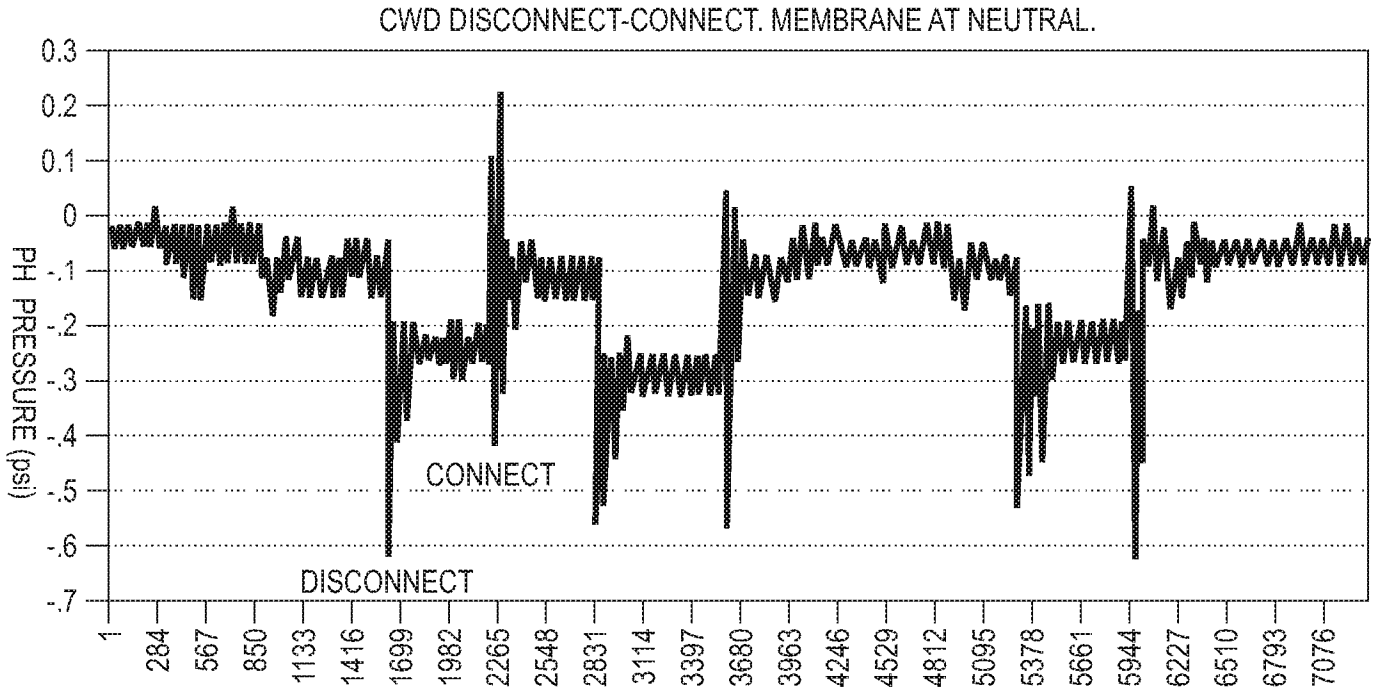
FIG. 6 shows a graph of pressure over time in the ink head line pressure in the presence of a compliant wall device.
Figure 7:
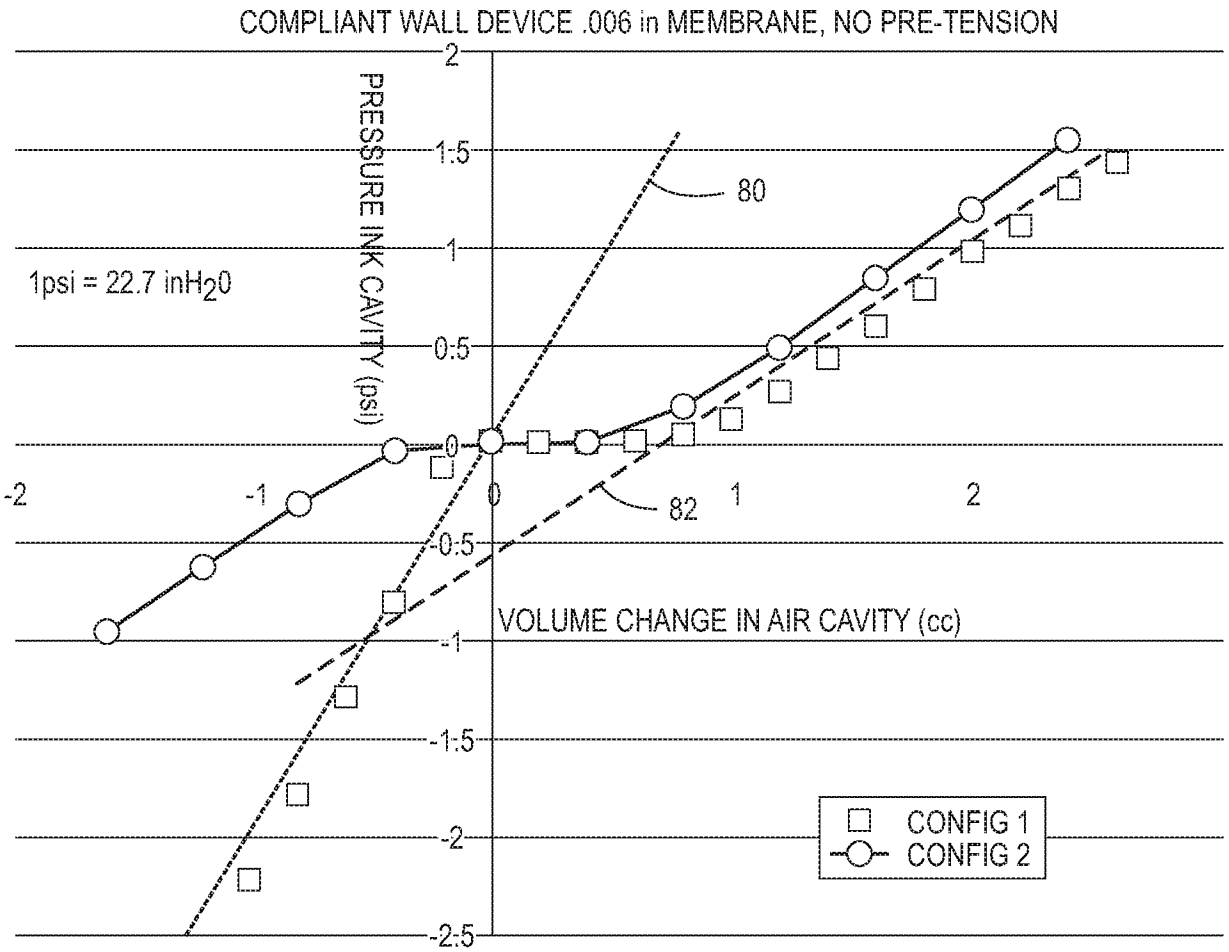
FIG. 7 shows pressure in an ink cavity over volume with a compliant wall device.

An experiment was conducted. FIG. 5 shows a graph of pressure spikes at the print head without the compliant wall device. At a disconnect and a connect, the negative pressure spike is approximately −3.6 psi. FIG. 6 shows the results with the compliant wall device. Note that the scale change between the two graphs. At a disconnect and connect with the compliant wall device the pressure spike is approximately −0.6 psi. The presence of the compliant wall device reduces the pressure spike by over 5 times. Both graphs show the spikes of the disconnect and connect processes.

FIG. 6 shows a graph of the compliant wall device. The slope of the line 80 is caused by the membrane hitting the wall of the housing. The slope of line 82 results from the membrane elasticity. In this graph, two embodiments are shown. In a first configuration, the membrane can only flex in one direction. This is shown in the graph by the line of circles. In a second configuration the membrane flexes in both directions. This is shown in the graph by the line of red squares.

In this manner, the negative pressure spikes can be handled by allowing the membrane to flex and absorb the change in pressure. The device can be easily connected and disconnected in existing print heads off all types, as well as future print heads.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A device, comprising:

a first connector arranged to connect to an ink supply;

a second connector arranged to connect to a print head;

a first chamber arranged between the first and second connectors, the first chamber forming an ink path from the first connector to the second connector;

a second chamber arranged adjacent to the first chamber;

a third chamber arranged adjacent to the first chamber on an opposite side of the second chamber; and a compliant wall between the first and second chambers.

2. The device of claim 1, further comprising a second compliant wall between the first chamber and the third chamber.

3. The device of claim, 1 further comprising a port connected to the third chamber.

4. The device of claim 3, further comprising a pressure regulator attached to the port.

5. The device of claim 1, further comprising a port connected to the first chamber orthogonal to the ink path.

6. The device of claim 1, wherein the first connector comprises a quick disconnect connector.

7. The device of claim 1, wherein the second connector comprises a quick disconnect connect.

8. The device of claim 1, wherein the connectors, chambers and wall are contained in a housing.

9. The device of claim 8, wherein the housing comprises three pieces and the compliant wall resides at a juncture between two of the pieces.

10. A system, comprising:

a print head;

an ink tank connected to the print head; and a compliant wall device connected between the print head and the ink tank, the compliant wall device having a first chamber forming an ink path between the print head and the ink tank and a second chamber, the first and second chamber separated by a compliant wall, and the compliant wall device has a third chamber and a second compliant wall between the third chamber and the first chamber.

11. The system of claim 10, further comprising a vacuum pump connected to the ink tank.

12. The system of claim 10, further comprising an ink delivery system connected to the ink tank.

* * * * *